US007828027B2

(12) United States Patent
Mangano et al.

(10) Patent No.: US 7,828,027 B2
(45) Date of Patent: Nov. 9, 2010

(54) REVERSIBLE TOTE

(75) Inventors: Joy Mangano, St. James, NY (US); Brian Scevola, Palm Harbor, FL (US)

(73) Assignee: Ingenious Designs, LLC, Edgewood, NY (US)

( * ) Notice: Subject to any disclaimer, the term of this patent is extended or adjusted under 35 U.S.C. 154(b) by 60 days.

(21) Appl. No.: 12/203,513

(22) Filed: Sep. 3, 2008

(65) Prior Publication Data

US 2009/0056843 A1 Mar. 5, 2009

Related U.S. Application Data

(60) Provisional application No. 60/970,174, filed on Sep. 5, 2007.

(51) Int. Cl.
*B65D 30/22* (2006.01)

(52) U.S. Cl. ..... 150/103; 150/100; 206/373; 206/372; 206/736

(58) Field of Classification Search ..... 190/103; 383/2, 8, 61.3; 224/581, 575; 206/372, 373, 206/736; 150/103, 100
See application file for complete search history.

(56) References Cited

U.S. PATENT DOCUMENTS

| | | | | | |
|---|---|---|---|---|---|
| 1,810,347 | A * | 6/1931 | Daitch | 383/2 |
| 2,029,905 | A | 2/1936 | Banner | |
| 2,063,850 | A | 12/1936 | Nemeth | |
| 2,086,326 | A * | 7/1937 | Goldberg | 2/66 |
| 2,580,796 | A * | 1/1952 | Kleiss et al. | 383/6 |
| 2,837,132 | A * | 6/1958 | Daust | 150/118 |
| 3,109,474 | A * | 11/1963 | Levi | 150/158 |
| 4,117,874 | A * | 10/1978 | Berenguer | 383/28 |
| 4,301,849 | A | 11/1981 | Litwack et al. | |
| 4,515,300 | A * | 5/1985 | Cohen | 224/153 |
| 4,782,874 | A * | 11/1988 | Chartier | 150/112 |
| 5,316,388 | A * | 5/1994 | Caligiuri | 383/127 |
| 5,490,619 | A * | 2/1996 | Boyar | 224/153 |
| 5,653,337 | A * | 8/1997 | Cirigliano | 206/373 |
| 5,692,660 | A * | 12/1997 | Stewart | 224/581 |
| 6,783,016 | B2 * | 8/2004 | Wang | 220/9.2 |
| 7,575,376 | B2 * | 8/2009 | Yu | 383/2 |
| 2006/0215938 | A1 * | 9/2006 | Yu | 383/2 |

* cited by examiner

*Primary Examiner*—Anthony Stashick
*Assistant Examiner*—Cynthia F Collado
(74) *Attorney, Agent, or Firm*—Kenyon & Kenyon LLP

(57) ABSTRACT

A reversible tote comprising a reversible body including first and second surfaces having different patterns. A first pair of openings may extend through a first side of the body to receive a first handle and a second pair of openings can extend through a second side of the body to receive a second handle. A interior lining may form a storage compartment and can be fixed proximate to an upper edge of the body. The interior lining may have a zipper to selectively open and close an end of the lining.

7 Claims, 5 Drawing Sheets

REVERSIBLE TOTE

CROSS REFERENCE TO RELATED APPLICATION

This application claims priority to U.S. Provisional Patent Application No. 60/970,174, filed on Sep. 5, 2007, which is incorporated herein by reference in its entirety.

TECHNICAL FIELD

The present application relates to a reversible tote including first and second surfaces having different patterns.

BACKGROUND OF INVENTION

Numerous reversible handbags have been developed.

For example, U.S. Pat. No. 4,301,849 to Litwack et al. discloses a reversible bag with finished inner and outer surfaces having a reversible zipper. Handles are attached to the inner portion and to the outer portion of the reversible bag.

In another example, U.S. Pat. No. 5,653,337 to Cirigliano shows a reversible bag of foldable construction for containing workmen's tools. The bag has a reversible folding wall with a reversible closure adapted to be changeable into multiple positions. The reversible bag is closable to form a bag, can be opened to allow access thereto, and is reversible to permit the bag to be turned inside out. In addition, a plurality of individual compartments adapted to contain workmen tools are provided. Lastly, a transport device is connected to the container panel for a workman to carry the bag in a plurality of modes, for example, either by hand or on shoulders as with a knapsack.

Other examples of reversible bags include U.S. Pat. No. 2,029,905 to Banner, U.S. Pat. No. 2,063,850 to Nemeth, and U.S. Pat. No. 2,086,326 to Goldberg.

These previously known reversible bags are not without drawbacks. For example, these bags have aesthetic and functional limitations.

Accordingly it is an object of the present application to provide a reversible tote that is stylish and which can display various patterns.

BRIEF DESCRIPTION

The present application relates to a reversible tote including first and second surfaces having different patterns.

In accordance with certain embodiments of the present invention, a reversible tote is provided comprising a reversible body including first and second surfaces having different patterns. A first pair of openings may extend through a first side of the body to receive a first handle and a second pair of openings can extend through a second side of the body to receive a second handle. A interior lining may form a storage compartment and can be fixed proximate to an upper edge of the body. The interior lining may have a zipper to selectively open and close an end of the lining. When the end of the lining is opened, the body can be configured to be pulled through the open end of the lining to display one of the first and second surfaces.

In accordance with other embodiments of the present invention, a method of reversing a tote is provided comprising the steps of providing a reversible body including first and second surfaces having different patterns, removing a first handle from a first pair of openings extending through a first side of the body, removing a second handle from a second pair of openings extending through a second side of the body, opening a interior lining being fixed proximate to an upper edge of the body, and pulling the body through the opening in the interior lining to display one of the first and second surfaces.

The invention may be embodied by numerous other devices and methods. The description provided herein, when taken in conjunction with the annexed drawings, discloses examples of the invention. Other embodiments, which incorporate some or all steps as taught herein, are also possible.

DETAILED DESCRIPTION

The present application relates to a reversible tote including first and second surfaces having different patterns.

Figure 1:
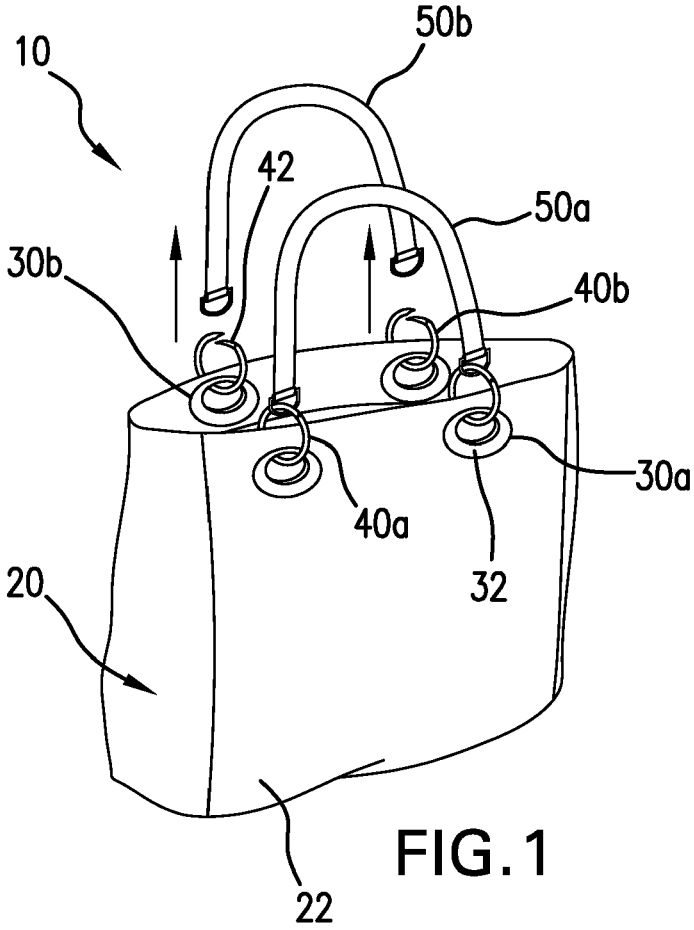
FIG. 1 shows a perspective view of the reversible tote showing a first pattern as may be employed in accordance with certain embodiments of the present invention.

Referring initially to FIG. 1, a reversible tote 10 is shown displaying a first pattern as may be employed in accordance with certain embodiments of the present invention. The reversible tote 10 includes a reversible body 20, a first and second pair of openings 30*a, b*, a first and second pair of clasps 40*a, b*, and first and second handles 50*a, b*.

Figure 7:
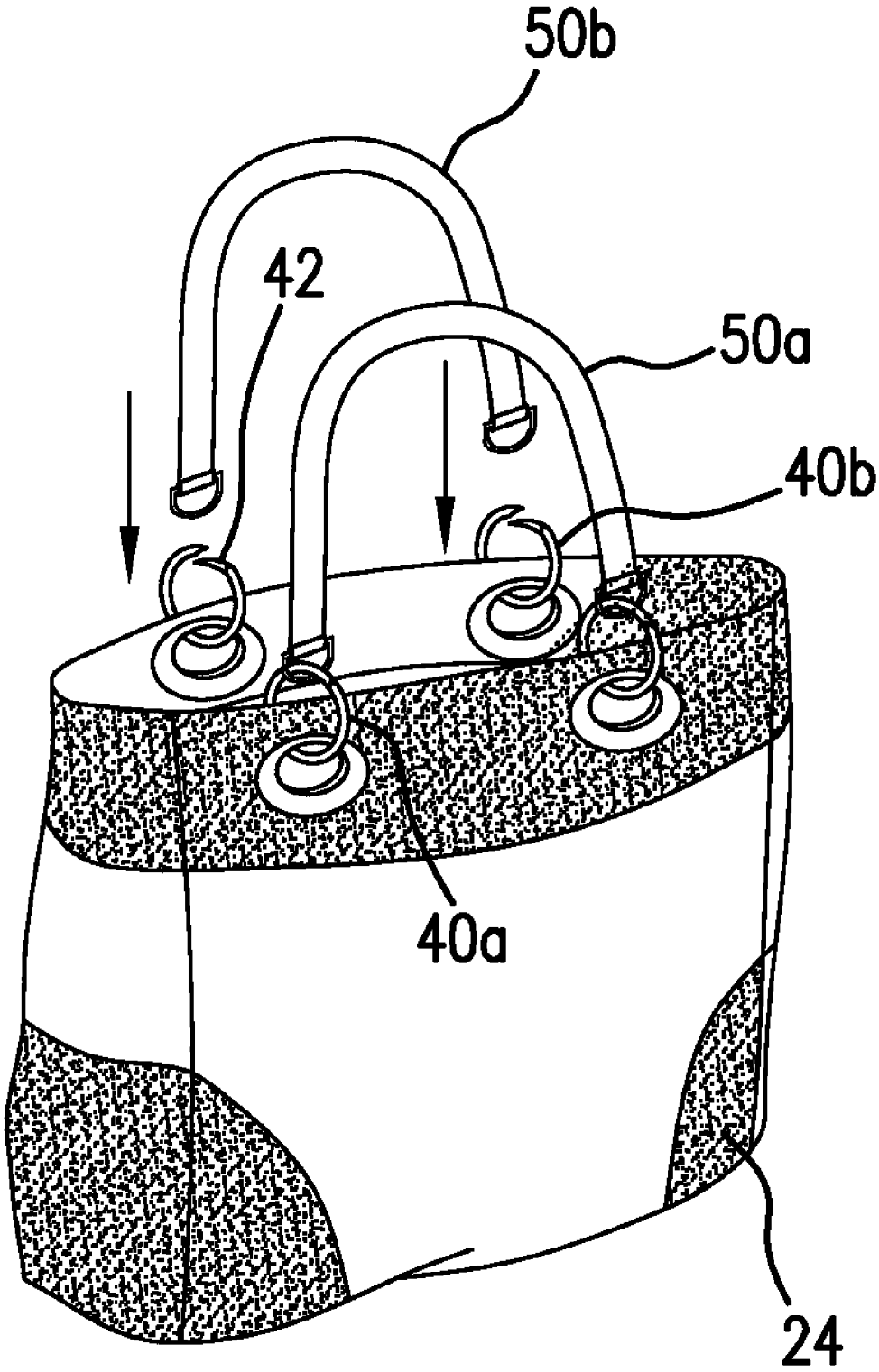
FIG. 7 shows a perspective view of the reversible tote showing a second pattern as may be employed in accordance with certain embodiments of the present invention.

As is seen in FIGS. 1 and 7, the body 20 includes first and second surfaces 22, 24 (FIG. 7) having different patterns. In the examples shown, the first pattern is solid white. The second pattern is white with a black edge and black corners. The black corner may be made of a different material and may include a different pattern. Other arrangements may be used. Suitable materials for the body include plastics, leather, cloth, and combinations thereof.

As seen in FIG. 1, extending along upper edges of the body are a first and second pair of openings 30*a*, b. The first pair of openings 30*a* may extend through a first side of the body 20 to receive the first handle 50*a* and the second pair of openings 30*b* can extend through a second side of the body 20 to receive the second handle 50*b*. The handles 50*a, b* can be directly connected to the openings 30*a, b* or indirectly connected via the clasps 40*a, b*. In the examples shown, the openings 30*a, b* are annular, however, any shape may be used for the openings. The openings may include supports 32 for decorative and/or functional purposes.

As discussed above, the reversible tote may also include a first and second pair of clasps 40*a, b*. The clasps 40*a, b* in the figures are circular; however, any shapes may be used. The clasps 40*a, b* have a hinged portion 42 that may be moved for positioning and securing of the handles thereto.

Referring again to FIG. 1, the first and second pair handles 50*a, b* will now be discussed in more detail. In the example shown, the handles 50*a, b* are U-shaped and have attachment members connected to an end thereof for connecting to the clasps; however, other shapes and arrangements may be used. In addition, as discussed above, although in the example the handles are connected to the clasp, it is contemplated by embodiments of the present application that the handles may be directly connected to the openings.

Figure 3:
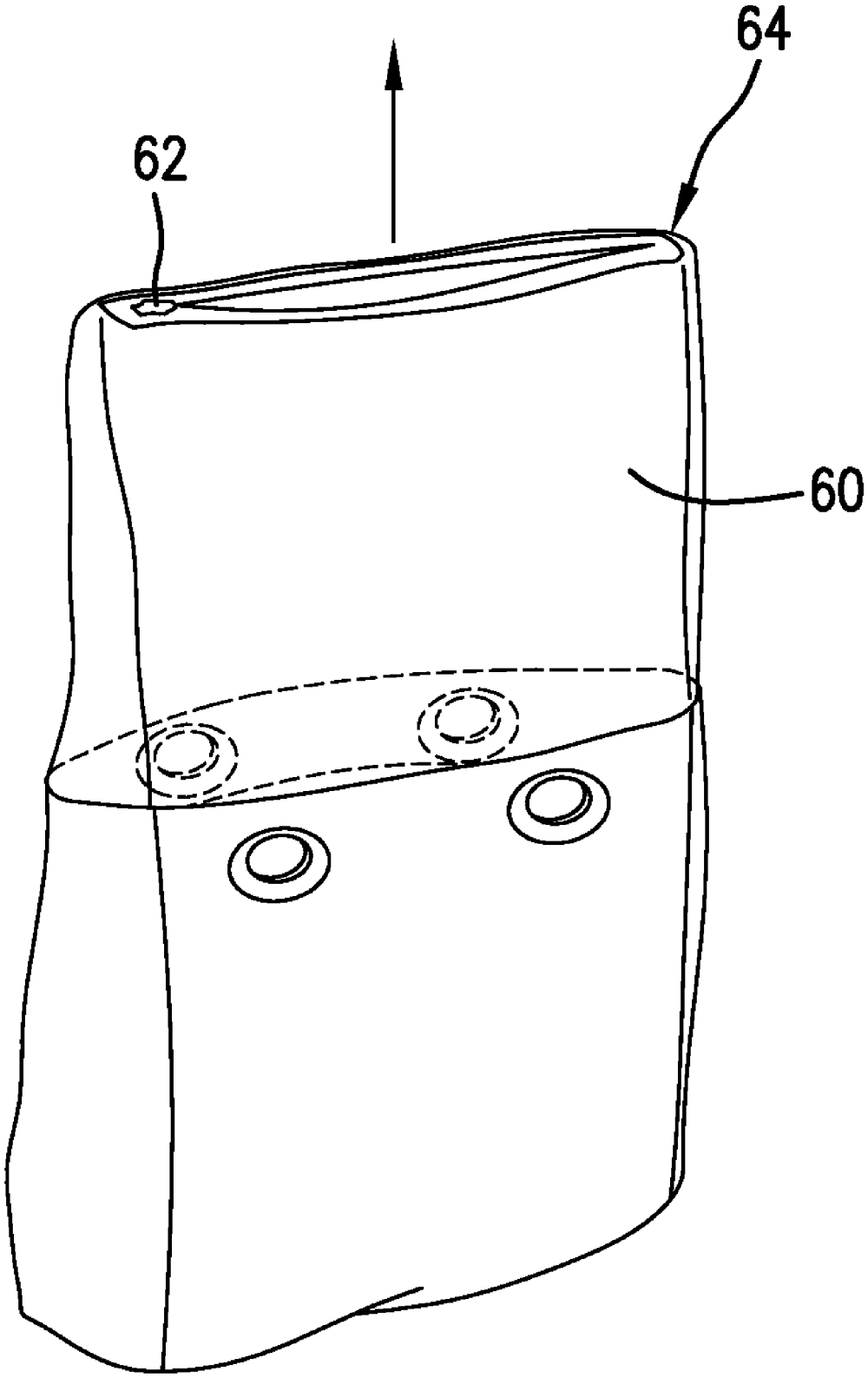
FIG. 3 shows a perspective view of the tote of FIG. 1 with the lining positioned outside of the tote.

Turning to FIG. 3, a interior lining 60 is shown forming a storage compartment. The interior lining 60 can be fixed proximate to an upper inside edge of the body. For example, suitable means such as stitching may be used. The interior lining 60 may have a zipper 62 to selectively open and close an end 64 of the lining 60. The zipper 62 may have gripping portions on both sides so that the zipper can be easily maneuvered from either side of the lining. Although a zipper is shown, other suitable fasteners may be used. Likewise, the lining may be manufactured from any suitable material.

Operation

Figure 2:
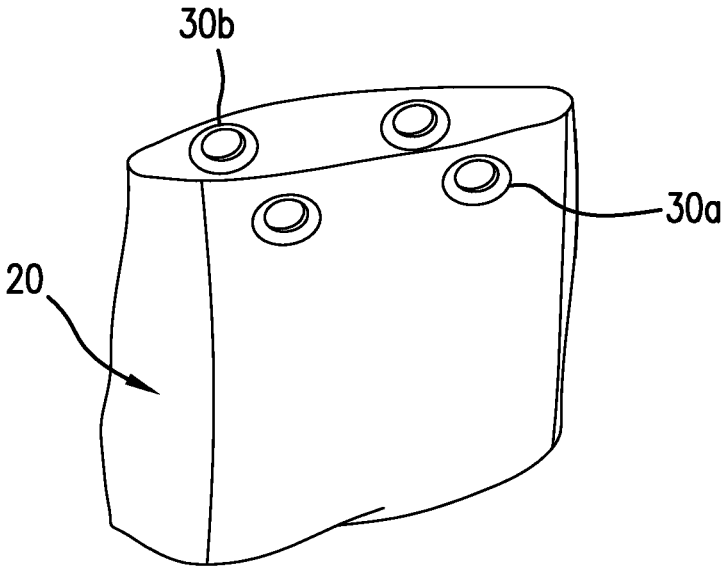
FIG. 2 shows a perspective view of the tote of FIG. 1 with the handles removed.
Figure 4:
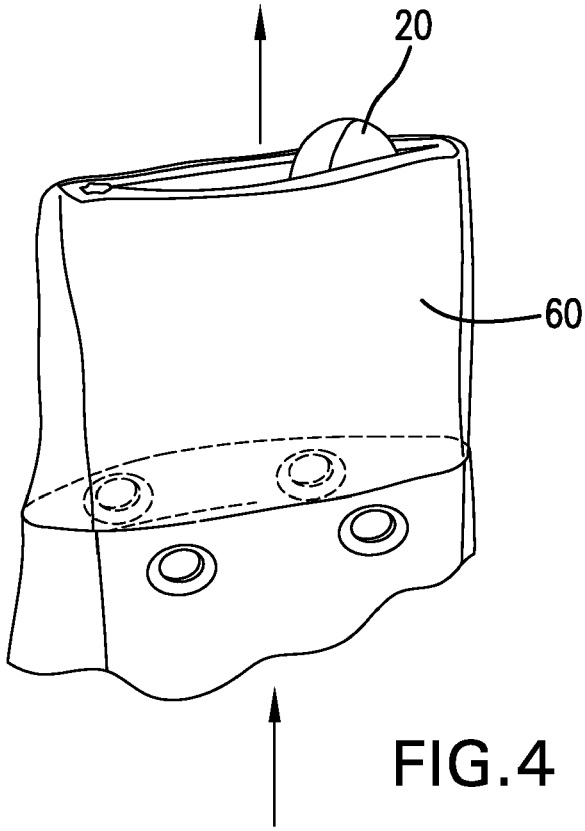
FIGS. 4-6 show the tote of FIG. 1 being reversed in accordance with certain embodiments of the present invention.
Figure 5:
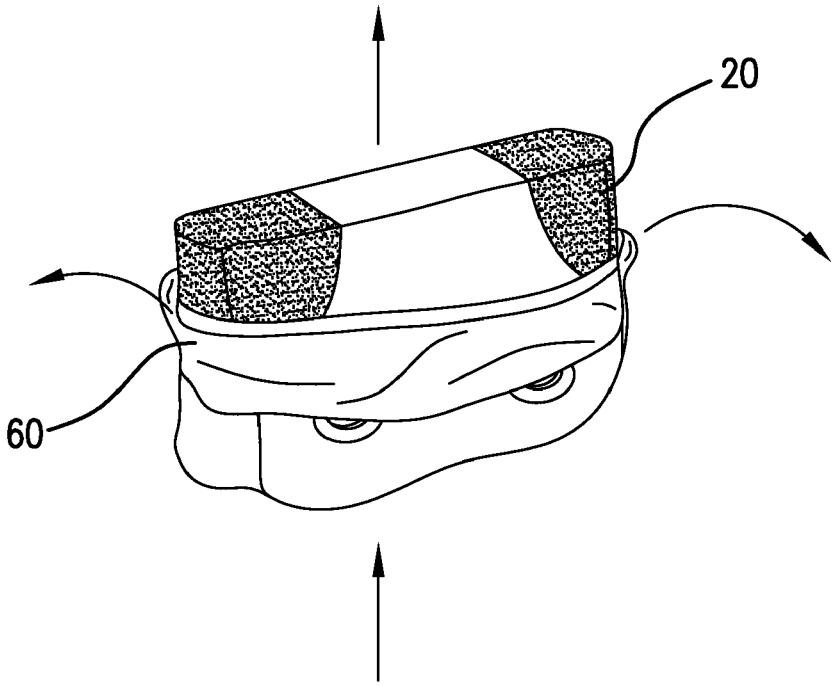
Figure 6:
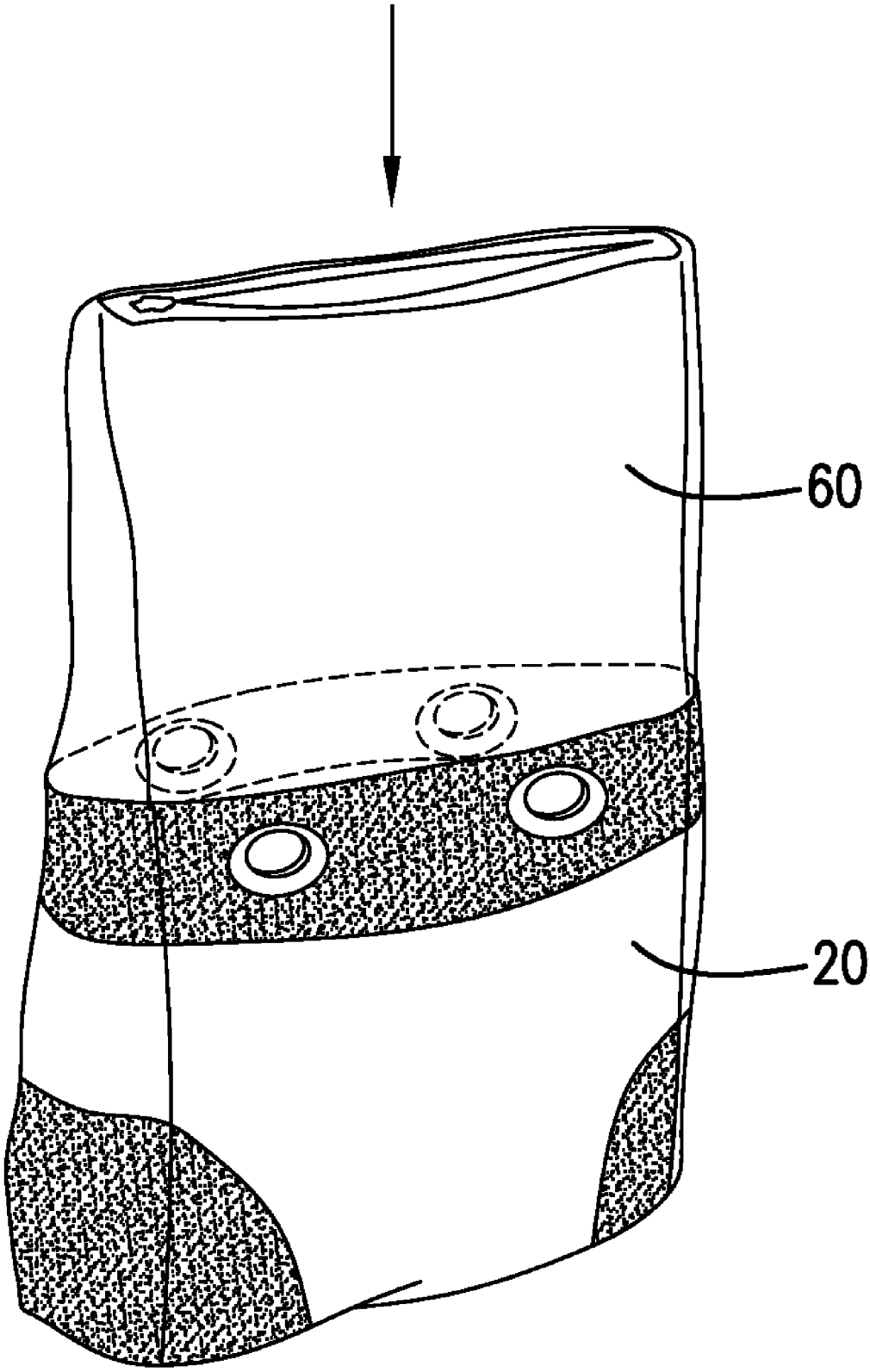

In accordance with certain embodiments of the present invention, a user may reverse the tote using the following steps. As seen in FIG. 2, the handles may be removed. Then, as seen in FIG. 3, the lining 60 can be removed from inside of the body. The zipper 62 on the liner 60 can then be moved so as to open an end 64 of the lining 60. Next, as seen in FIGS. 4-5, the body 20 can be pulled through the opening in the open end 64 of the lining 60 so as to display the second surface of the body having a second pattern. As seen in FIG. 6, the interior lining 60 can then be positioned back into the body. Lastly, as seen in FIG. 7, the handles 50*a, b* and clasps 40*a, b* may be reattached to the openings of the body.

While the present invention is described with respect to particular examples and preferred embodiments, it is understood that the present invention is not limited to these examples and embodiments. The present invention as claimed therefore includes variations from the particular examples and preferred embodiments described herein, as will be apparent to one of skill in the art.

What is claimed is:

1. A reversible tote, comprising:

a reversible body including first and second surfaces having different patterns;

a first pair of openings extending through a first side of the body to receive a first handle and a second pair of openings extending through a second side of the body to receive a second handle; and an interior lining forming a storage compartment being fixed at an upper end proximate to an upper edge of the body, the interior lining having a zipper at a bottom end to selectively open and close the bottom end of the lining, wherein when the bottom end of the lining is opened, the body is configured to be pulled through the open bottom end of the lining to display one of the first and second surfaces.

2. The tote of claim 1, wherein the handles are removable.

3. The tote of claim 1, further comprising first and second pairs of clasps arranged between the openings and handles.

4. A reversible tote, comprising:

a reversible body including first and second surfaces having different patterns;

a first pair of openings extending through a first side of the body to receive a first pair of clasps and a second pair of openings extending through a second side of the body to receive a second pair of clasps;

first and second handles being positionable on the clasps; and an interior lining forming a storage compartment being fixed at an upper end proximate to an upper edge of the body, the interior lining having a zipper at a bottom end to selectively open and close the bottom end of the lining, wherein when the bottom end of the lining is opened, the body is configured to be pulled through the open bottom end of the lining to display one of the first and second surfaces.

5. A method of reversing a tote, comprising:

providing a reversible body including first and second surfaces having different patterns;

removing a first handle from a first pair of openings extending through a first side of the body;

removing a second handle from a second pair of openings extending through a second side of the body;

providing an interior lining forming a storage compartment being fixed at an upper end proximate to an upper edge of the body, the interior lining having a zipper at a bottom end to selectively open and close the bottom end of the lining, opening the bottom end of the lining;

pulling the body through the bottom end opening in the interior lining to display one of the first and second surfaces.

6. The method of claim 5, further comprising reattaching the handles.

7. The method of claim 5, further comprising first and second pairs of clasps arranged between the openings and handles.

* * * * *